US006506072B2

(12) United States Patent
Nimura

(10) Patent No.: US 6,506,072 B2
(45) Date of Patent: Jan. 14, 2003

(54) CONNECTOR FOR A FLAT CABLE

(75) Inventor: Kazuhiko Nimura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/861,536

(22) Filed: May 22, 2001

(65) Prior Publication Data

US 2001/0051454 A1 Dec. 13, 2001

(30) Foreign Application Priority Data

Jun. 7, 2000 (JP) ..... 2000-170799

(51) Int. Cl.[7] ..... H01R 4/24; H01R 4/26; H01R 11/20

(52) U.S. Cl. ..... 439/405

(58) Field of Search ..... 439/404, 405, 439/456, 468, 459, 417, 499, 460, 466

(56) References Cited

U.S. PATENT DOCUMENTS

| | | | | |
|---|---|---|---|---|
| 3,214,713 A | * | 10/1965 | Strobel | 439/466 |
| 4,556,270 A | * | 12/1985 | Schutzle et al. | 439/460 |
| 4,897,041 A | | 1/1990 | Heiney et al. | 439/404 |

FOREIGN PATENT DOCUMENTS

| | | |
|---|---|---|
| EP | 000 088 | 12/1978 |
| EP | 097 018 | 12/1983 |
| EP | 381 380 | 8/1990 |

* cited by examiner

*Primary Examiner*—Javaid Nasri
(74) *Attorney, Agent, or Firm*—Banner & Witcoff, Ltd.

(57) ABSTRACT

The invention provides a plurality of optional distributing directions for a flat cable. Pressure contact terminal fittings 20 are attached within a housing 10, pressure contact blades 22 of these pressure contact terminal fittings 20 being in an exposed state. A holder 30 is attached to the housing 10, this holder 30 covering a pressure contact distributing path 40 (a pressure contact area) of the pressure contact blades 22 and a flat cable F. The flat cable F, which has been attached by means of pressure contact, is led to the exterior of the housing 10 via through paths 43 or 44 that join with the pressure contact distributing path 40. The two differing through paths, 43 and 45 join with at least one of the distributed ends of the flat cable F that is located within the pressure contact distributing path 40, and lead the flat cable F to the exterior in differing distributing directions. Consequently, the portions of the flat cable F that are distributed to the exterior can optionally be lead along the through paths 43 or the through paths 45, depending on which distributing path is more suitable.

14 Claims, 4 Drawing Sheets

CONNECTOR FOR A FLAT CABLE

TECHNICAL FIELD

The present invention relates to an electrical connector for a flat cable.

BACKGROUND TO THE INVENTION

Conventionally, a connector for a flat cable has pressure contact terminal fittings attached to a housing. A flat cable is attached to these pressure contact terminal fittings, by means of pressure contact. One example of this type of connector is described in U.S. Pat. No. 4,897,041.

In this type of connector, pressure contact blades of the pressure contact terminal fittings are exposed at an outer face of the housing, and a holder is attached so as to cover these exposed portions. When pressure contact is to occur, the flat cable is positioned so as to correspond to the pressure contact blades and, while it is in this state, the holder is attached to the housing. At this juncture, the holder pushes the pressure contact blades into the flat cable, thereby joining the flat cable, by means of pressure contact, to the pressure contact terminal fittings.

The flat cable that has been joined by pressure contact extends outwards from the connector through a space between the housing and the holder. In conventional connectors used for flat cables, there is only one extending direction and position of the flat cables. Consequently, if the flat cable needs to be distributed in a direction differing from the direction in which it extends from the connector, a space for bending the flat cable is required outside the connector.

SUMMARY OF THE INVENTION

According to the invention there is provided an electrical connector for a flat cable and comprising a housing defining a pressure contact region, a pressure contact terminal within said region and adapted for contact with a flat cable and a cover for said region, said connector defining a pathway for said cable via said region to the exterior of said connector, wherein said connector defines a plurality of through paths for said cable, said through paths extending via said region and adapted to lead said cable from said connector along different distribution pathways.

Such a connector increases the possibilities of cable exit direction by providing through paths within the connector itself. Accordingly the path of the cable is determined by the connector, and is neither undefined nor requiring a bending space outside the connector.

The paths for the cables may be defined between the connector and cover and/or through the cover. The paths are preferably serpentine in order to avoid strain in the connection region as a result of tension in the cable.

The housing may include opposite protrusions to laterally locate a cable in said region. These protrusions preferably engage corresponding recesses of a cover in a form-locking or shaped guiding manner so as to prevent lateral movement of the cover with respect to the housing.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 7.

Figure 1:
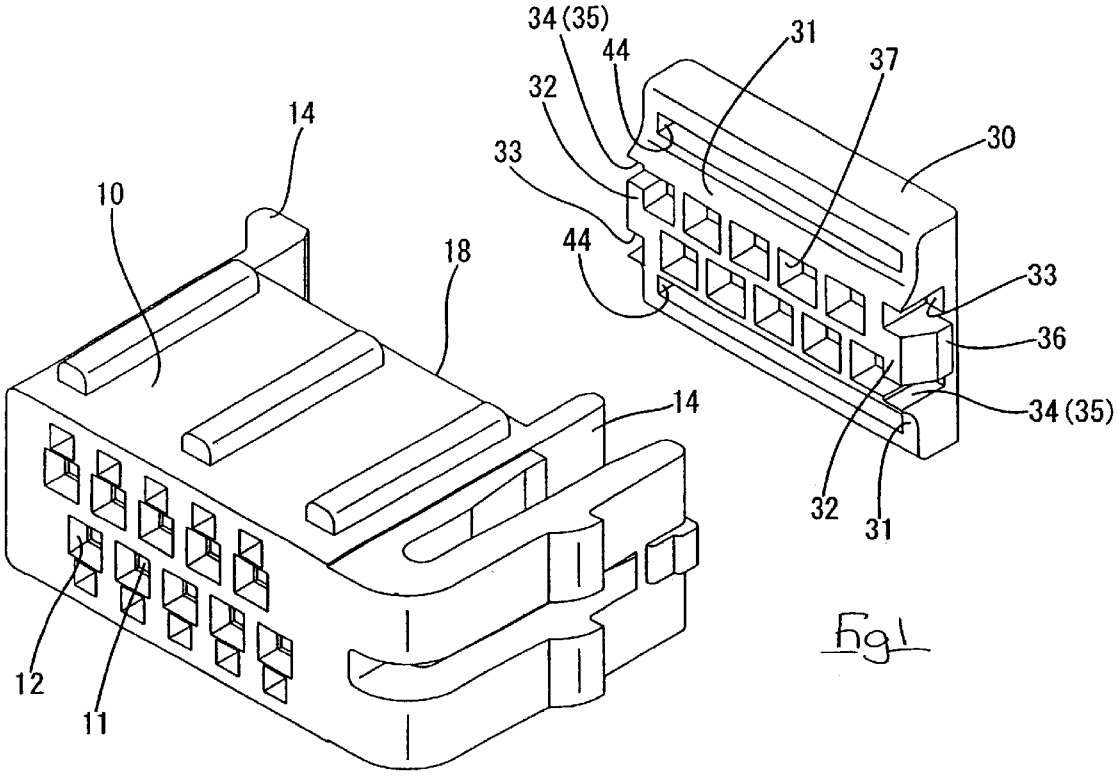
FIG. 1 is a disassembled diagonal view showing a housing and a holder of an embodiment of the invention in a separated state.
Figure 2:
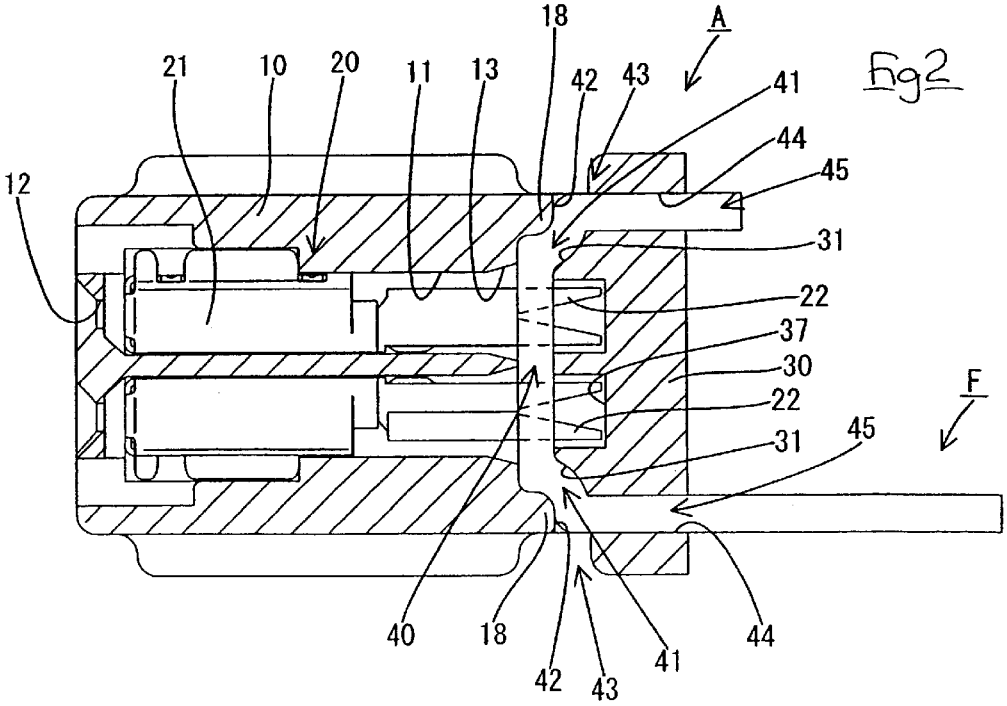
FIG. 2 is a vertical cross-sectional view showing one example of the distribution of a flat cable in a joined state.
Figure 3:
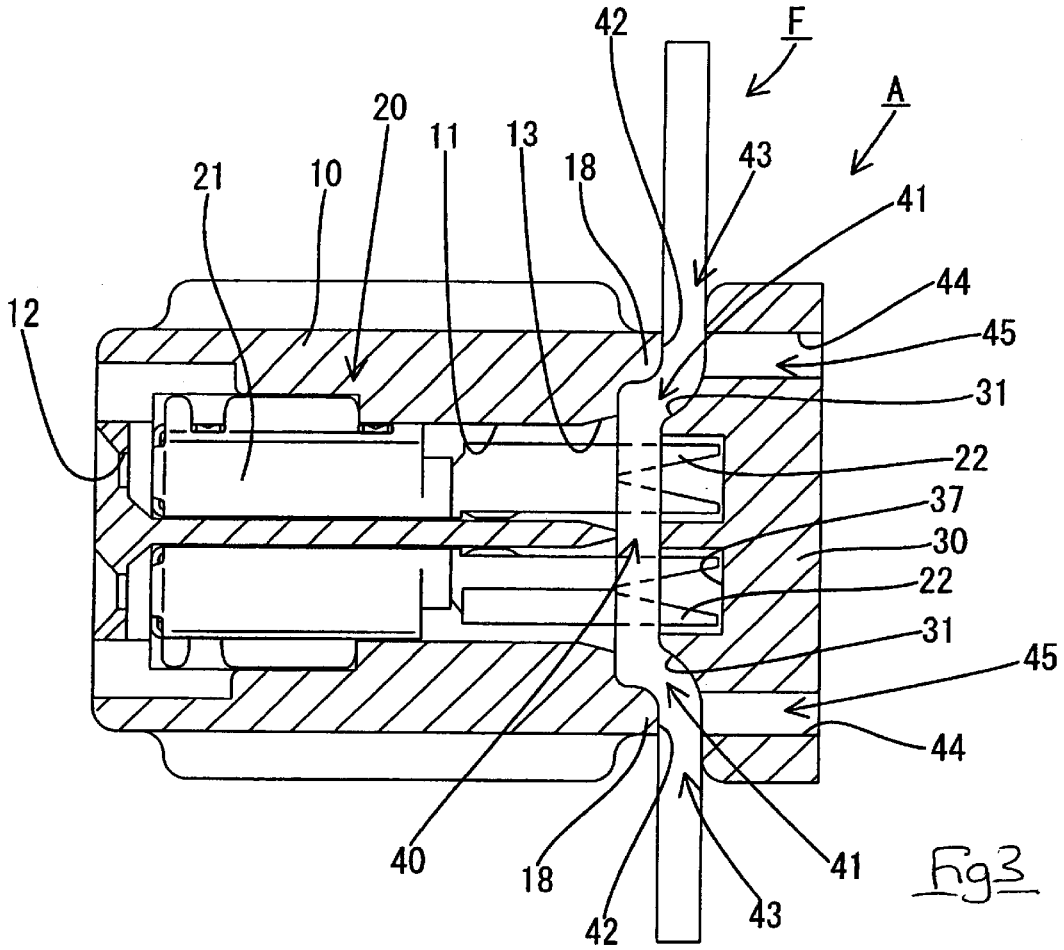
FIG. 3 is a vertical cross-sectional view showing an alternative distribution of the flat cable in a joined state.
Figure 4:
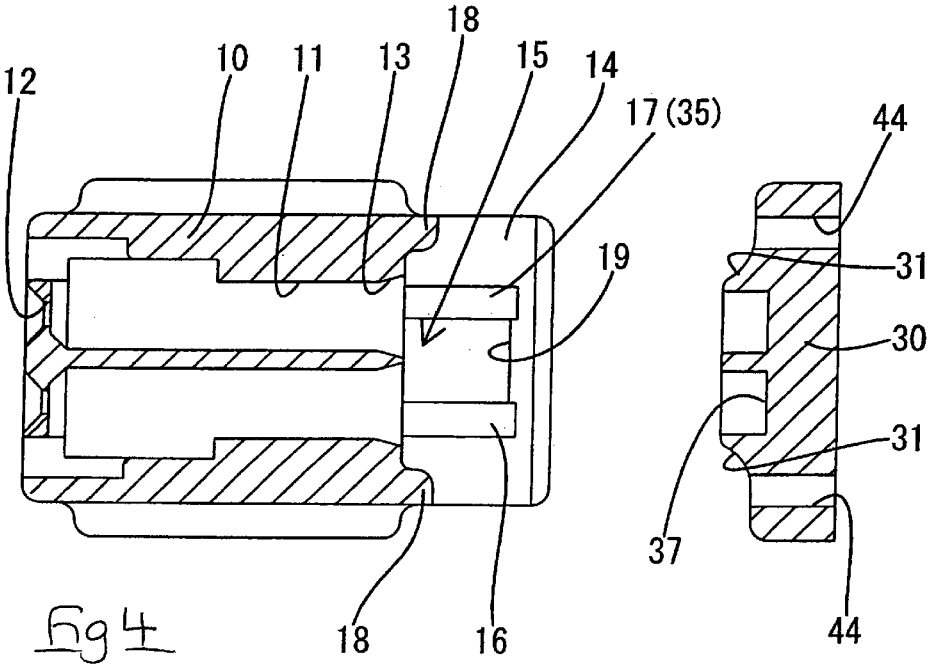
FIG. 4 is a vertical cross-sectional view showing the housing and the holder in a separated state.
Figure 5:
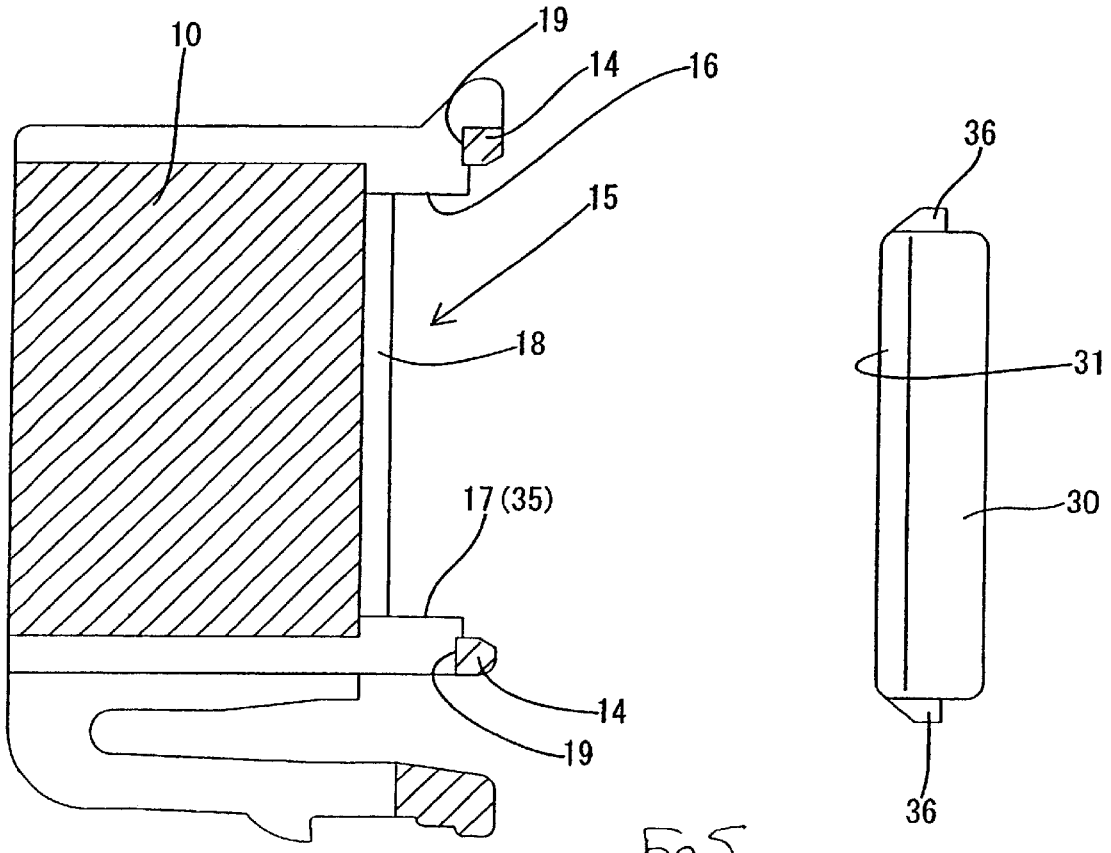
FIG. 5 is a horizontal cross-sectional view showing the housing and the holder in a separated state.

A connector A for a flat cable is formed from a housing 10, a plurality of pressure contact terminal fittings 20, and a holder 30. In the following description, the left side in FIGS. 2 to 5 is the anterior side. FIGS. 2 and 3 are taken to be the norm for the up-down direction. In FIG. 5, the upper side is the right side.

The housing 10 is made from plastic, and a plurality of cavities 11 are formed therein. These cavities 11 are divided into an upper and a lower row and are aligned in a left-right direction. An anterior end of each cavity 11 opens onto an anterior end face of the housing 10, this forming a terminal housing hole 12. Pressure contact terminal fittings 20 that have been inserted into the cavities 11 join with corresponding terminal fittings (not shown) via these terminal housing holes 12. Posterior ends of the cavities 11 open onto a posterior end face of the housing 10, these forming terminal inserting holes 13. The pressure contact terminal fittings 20 are inserted into the cavities 11 through the terminal inserting holes 13.

Figure 6:
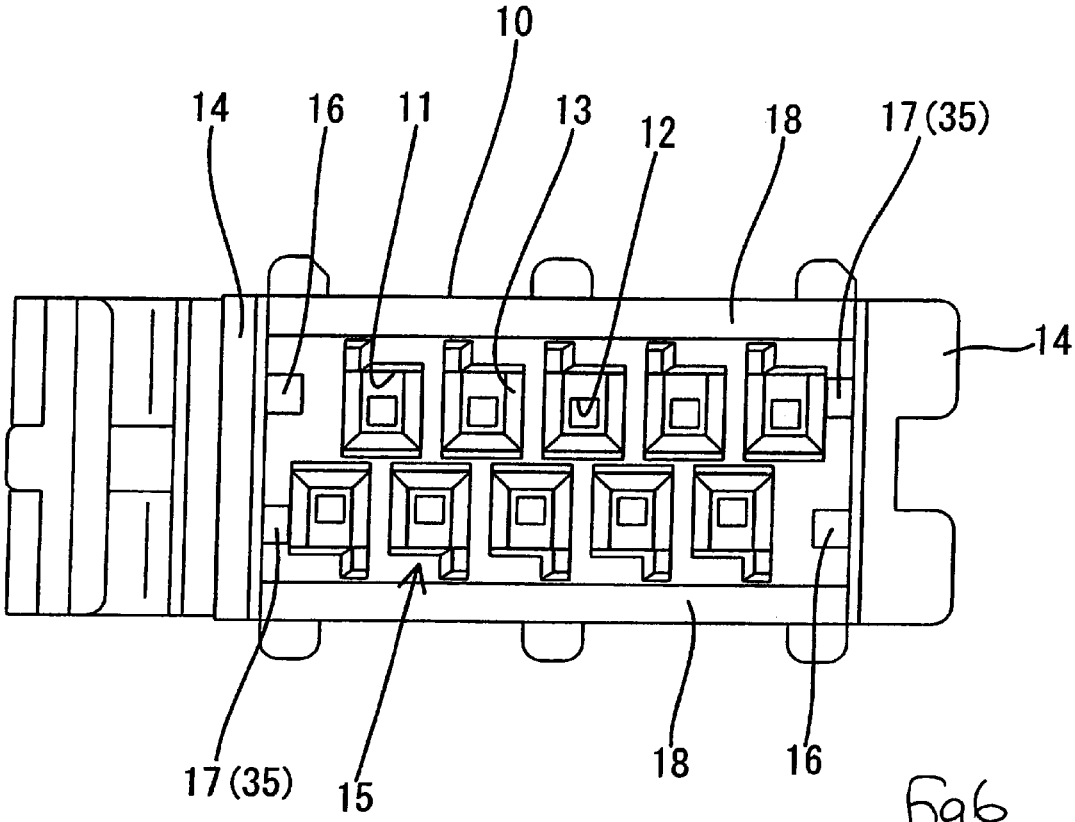
FIG. 6 is a rear face view of the housing.
Figure 7:
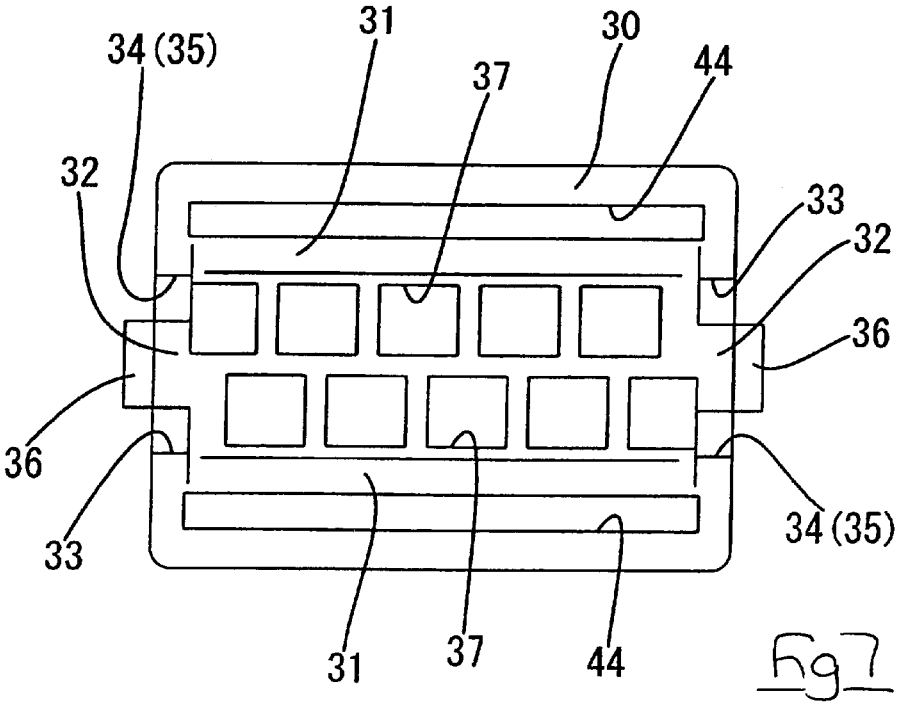
FIG. 7 is a front view of the holder.

A pair of protecting walls 14 extend towards the posterior from left and right edges of the posterior end face of the housing 10. The space between these protecting walls 14 forms a pressure contact space 15. Pressure contact blades 22 of the pressure contact terminal fittings 20 extend into this pressure contact space 15, and a flat cable F is joined by pressure contact to the pressure contact blades 22 within this pressure contact space 15. The distance between inner side faces of the two protecting walls 14 is considerably greater than the width of the flat cable F. However, position fixing members 16 protrude from the inner side faces of the protecting walls 14. The distance between protruding side faces of these left and right position fixing members 16 is approximately the same as the width of the flat cable F. The position fixing members 16 are rib like, and extend parallel to the direction in which the holder 30 is attached to the housing 10 (that is, an anterior-posterior direction). As shown in FIG. 6, the right position fixing member 16 is provided on a lower portion of the protecting wall 14, and the left position fixing member 16 is provided on an upper portion of the protecting wall 14.

A guiding rib 17 is formed on the inner side face of each protecting wall 14. These guiding ribs 17 extend parallel to the direction in which the holder 30 is attached to the housing 10 (that is, an anterior-posterior direction). As shown in FIG. 6, the right guiding rib 17 is provided on the upper portion of the protecting wall 14, and the left guiding rib 17 is provided on the lower portion of the protecting wall 14. A pair of maintaining ribs 18 extend in a left-right direction from upper and lower edges of the posterior end face of the housing 10. As will be explained later, these maintaining ribs 18 define part of strain relieving channels 41 that maintain the flat cable F in a bent state. Furthermore, portions of the protecting walls 14 are cut away in a slit shape at an approximately central location relative to the height thereof (that is, at a height between the guiding ribs 17 and the position fixing members 16), these forming locking holes 19. The distance to which the guiding ribs 17 protrude from the protecting walls 14 is shorter than the protruding distance of the position fixing members 16, and is such that the guiding ribs 17 do not make contact with the flat cable F.

The pressure contact terminal fittings 20 are formed by bending metal material that has been stamped into a specified shape. An anterior half of each pressure contact terminal fitting 20 forms an angular tubular-shaped fitting member 21 that fits with a corresponding terminal fitting (not shown). Pressure contact blades 22 are formed at a posterior end of each pressure contact terminal fitting 20. These pressure contact blades 22 protrude (that is, they are exposed) from the posterior end face of the housing 10 into the posteriorly-located pressure contact space 15, waiting to perform pressure contact. Pressure contact is performed by pressing these pressure contact blades 22 from the posterior when the flat cable F is in a state whereby it faces up and down along its lengthwise direction (that is, in a state where a conductor (not shown) faces the up-down direction). In the pressure-contacting state, the flat cable F is attached tightly to the posterior end face of the housing 10 as a result of being pushed by the holder 30 (to be explained).

The holder 30 is made from plastic and has thick plate shape, it is brought close to the housing 10 by being attached within the pressure contact space 15. When the holder 30 is in the attached state, a space is formed between an anterior end face of the holder 30 and the posterior end face of the housing 10. This space has the same size as, or is smaller than, the thickness of the flat cable F. This space forms a pressure contact distributing path 40 (this corresponds to the pressure contact area of the present invention) in which the portion of the flat cable F that makes pressure contact with the pressure contact blades 22 is distributed in an up-down direction and in a flat state. A pair of maintaining grooves 31 are formed at upper and lower edges of the anterior end face of the holder 30. These correspond to the maintaining ribs 18 of the housing 10. The strain relieving channels 41 are formed in the spaces between the maintaining grooves 31 and the maintaining ribs 18. Viewed from the side, these strain relieving channels 41 are L-shaped (or have quarter arc shapes) and have the same width as the pressure contact distributing path 40. A lower edge portion of the strain relieving channels 41 joins at a right angle with an upper edge of the pressure contact distributing path 40, and an upper edge portion of the strain relieving channels 41 joins at a right angle with a lower edge of the pressure contact distributing path 40.

When the housing 10 and the holder 30 are in an attached state, a slit-shaped distributing opening 42 that is long and narrow in a left-right direction is formed between the maintaining rib 18 at an upper edge of the housing 10 and an upper edge of the holder 30. The flat cable F can be led out to the exterior of the connector A through this distributing opening 42. The distributing opening 42 joins with an upwards-facing upper edge of the strain relieving channel 41, and faces the same direction as this strain relieving channel 41. Another slit-shaped distributing opening 42 that is long and narrow in a lef-right direction is formed between the maintaining rib 18 at a lower edge of the housing 10 and a lower edge of the holder 30. The flat cable F can be led out to the exterior of the connector A through this distributing opening 42. This lower distributing opening 42 joins with a downwards-facing lower edge of the strain relieving channel 41, and faces the same direction as this strain relieving channel 41. These distributing openings 42 and strain relieving channels 41 constitute first through paths 43 that can lead the flat cable F upwards or downwards from the pressure contact distributing path 40 to the exterior of the connector A.

An upper and lower pair of through holes 44 are formed at the upper edge of the upper strain relieving channel 41 and the lower edge of the lower strain relieving channel 41, respectively. Both through holes 44 are located the same distance inwards relative to the respective upper and lower edges. The through holes 44 pass through the holder 30 in an anterior-posterior direction, and have a long and narrow slit shape in the left-right direction. The widthwise dimensions of the through holes 44 is the same or slightly greater than the widthwise dimension of the flat cable F. An opening at an anterior end of the upper through hole 44 joins at an approximate right angle with the upper edge of the upper strain relieving channel 41, and an opening at an anterior end of the lower through hole 44 joins at an approximate right angle with a lower edge of the lower strain relieving channel 41. These through holes 44 and strain relieving channels 41 constitute second through paths 45 that lead the flat cable F towards the posterior from the pressure contact distributing path 40 to the exterior of the connector A.

Recesses 33, which correspond to the position fixing members 16 of the housing 10, and guiding grooves 34, which correspond to the guiding ribs 17, are formed in left and right outer walls 32 (these correspond to the wall members of the present invention) of the holder 30. The recesses 33 and guiding grooves 34 extend in the direction in which the holder 30 is attached to the housing 10. The guiding grooves 34 and the guiding ribs 17 constitute a guiding means 35 of the present invention. When the holder 30 is to be attached to the housing 10, these guiding grooves 34 and guiding ribs 17 fit together so as to prevent the holder 30 from rattling in either the up-down or left-right directions, and the position fixing members 16 enter the recesses 33. The recesses 33 and grooves 34 are formed with the wall thickness of the outer walls 32, and open onto the anterior end face of the holder 30 and outer side faces of the outer walls 32. These outer walls 32 (which have the recesses 33 and the guiding grooves 34 formed therein) have outwardly-protruding locking protrusions 36 formed thereon. When the holder 30 has been correctly attached to the housing 10, these locking protrusions 36 engage with posterior edges of the locking holes 19, this preventing the holder 30 from being removed, in the posterior direction, from the housing 10. Furthermore, recesses 37 are formed in the anterior end face of the holder 30, these preventing interference between the holder 30 and the pressure contact blades 22.

Next, the operation of the present embodiment will be described.

First, the case is described in which the flat cable F is attached so as to be led to the posterior of the connector A (see FIG. 2). In this case, the flat cable F is first passed through the upper and lower through holes 44 of the holder 30, and the portion of the flat cable F that will make pressure contact with the pressure contact blades 22 extends along the anterior end face of the holder 30. In this state, the holder 30 is attached to the housing 10. As this attachment takes place, the flat cable F is pushed by the anterior end face of the holder 30, thereby making pressure contact with the pressure contact blades 22. While this attachment and pressure contact is occurring, the guiding ribs 17 fit with the guiding grooves 34, thereby preventing the holder 30 from moving in the up-down or left-right directions relative to the housing 10.

When the holder 30 has been attached, it is locked in this attached state by the locking protrusions 36 engaging with the locking holes 19. In this locked state, the engagement of the locking protrusions 36 and the locking holes 19 prevents the holder 30 from moving in an up-down direction relative to the housing 10. Furthermore, the left and right outer side faces of the holder 30 make contact with the inner side faces of the protecting walls 14, thereby preventing the holder 30 from moving in a left-right direction.

The flat cable F, which has been joined by pressure contact, is led from the pressure contact distributing path 40 to the exterior of the connector A via the upper and lower second through paths 45. An end portion of the flat cable F protrudes slightly to the posterior from the upper through hole 44, and a longer portion of the flat cable F is led from the lower through hole 44. When the flat cable F is in this distributed state, it is led in the same direction as the lengthwise direction of the housing 10 (that is, the fitting direction of the connector A with a corresponding connector A (not shown)). This distributed state is ideal for joining the connector A with the end portion of the flat cable F.

The flat cable F, which has been distributed in a flat state (that is, in a straight line) within the pressure contact distributing path 40, is gripped in a bent state within the following portions of the second through paths 45: the portion where the strain relieving channels 41 join the pressure contact distributing path 40, and the portion where the strain relieving members 41 join the through holes 44. Consequently, the flat cable F is prevented from moving in a lengthwise direction at these bent portions even if a pulling force is exerted thereon from the exterior, thus ensuring that the pulling force will not reach the portion of the flat cable F that makes pressure contact with the pressure contact blades 22. As a result, the pressure contacting state of the flat cable F can be reliably maintained.

In the case where the flat cable F is led in an up-down direction from the connector A (as shown in FIG. 3), the flat cable F is first positioned within the pressure contact space 15 of the housing 10, the position fixing members 16 preventing the flat cable F from moving to the left or right relative to the housing 10. In this state, the holder 30 is attached to the housing 10. While this attachment is taking place, the holder 30 pushes the flat cable F towards the anterior, this pushing operation causing the flat cable F to make pressure contact with the pressure contact blades 22.

The flat cable F, which has been joined by pressure contact, is led from the pressure contact distributing path 40 to the exterior of the connector A via the upper and lower first through paths 43. The flat cable F is led upwards from the upper distributing opening 42, and is led downwards from the lower distributing opening 42. When the flat cable F is in this distributed state, it is led in a direction at a right angle to the lengthwise direction of the housing 10 (that is, the fitting direction of the connector A with a corresponding connector A (not shown)). This distributed state is ideal for joining the connector A with the flat cable F part-way along the distributing path thereof.

The distributing states of the flat cable F are not limited to those shown in FIGS. 2 and 3. For example, in FIG. 2 of the flat cable F is led only along the second through paths 45. However, the portion of the flat cable F that is passed though the upper through hole 44 may equally well be led outwards from the upper distributing opening 42 of the first through path 43. Alternatively, the portion of the flat cable F that is passed through the lower through hole 44 in FIG. 2 may equally well be led outwards from the lower distributing opening 42 of the first through path 43. In addition, in FIG. 3 the flat cable F is led only along the first through paths 43. However, the portion of the flat cable F that is passed through the upper distributing opening 42 may equally well be led outwards from the upper through hole 44 of the second through path 45. Alternatively, the portion of the flat cable F that is passed through the upper distributing opening 42 in FIG. 3 may equally well be led outwards from the lower through hole 44 of the second through path 45.

In the embodiment described above, there are two paths that join both distributed ends of the flat cable F located within the pressure contact distributing path 40: the first through paths 43 and the second through paths 45. These lead the flat cable F in different directions to the exterior. Consequently, the portions of the flat cable F that are led to the exterior can be led optionally along either of these through paths 43 and 45, depending on which path is the most suitable.

Furthermore, the ends of the first through paths 43 and the second through paths 45 that join with the pressure contact distributing path 40 are formed as strain relieving channels 41 that are bent. Consequently, a pulling force exerted on the flat cable F from the exterior will be received by these bends and will not reach the portion of the flat cable F making pressure contact with the pressure contact blades 22.

Moreover, if the strain relieving channels 41 (these having a bent path) are formed as single units through which the flat cable F must be passed, both the moulding of these units and the operation of passing the flat cable F therethrough is problematic. However, in the present embodiment, the strain relieving channels 41 are formed between the housing 10 and the holder 30. Consequently, the moulding of the housing 10 and the holder 30 is straightforward, as is the distribution of the flat cable F.

The strain relieving channels 41 function as paths for both the first through paths 43 and the second through paths 45. Consequently, the configuration is simpler compared to the case where separate strain relieving channels 41 must be provided for the first through paths 43 and the second through paths 45.

The first through paths 43 open to the exterior at the distributing openings 42 located in the space between the housing 10 and the holder 30. The second through paths 45 pass through the through holes 44 of the holder 30 and open to the exterior at the posterior side face (that is, the surface face) of the holder 30. In this manner, the exterior openings of the through paths 43 and 45 are in mutually differing locations and the portions of the flat cable F that are led to the exterior can be led optionally through either of the through paths 43 and 45, according to whichever is the most suitable distributing path.

The housing 10 is provided with the position fixing members 16, these fixing the position of the flat cable F in the widthwise direction. As a result, the flat cable F can reliably be joined by pressure contact with the conductor (not shown) and the pressure contact blades 22.

Further, the housing 10 and the holder 30 are provided with the guiding means 35. This is formed from the guiding ribs 17 and the guiding grooves 34, which extend in the direction in which the housing 10 and the holder 30 are joined together. As a result, the holder 30 can be attached reliably to the housing 10.

The housing 10 and the holder 30 are provided with the locking means comprising the locking holes 19 and the locking protrusions 36. When the housing 10 and the holder 30 are in a joined state, this locking means locks the two together. The guiding grooves 34 of the guiding means 35 are cut into the outer walls 32 (which have the locking protrusions 36 formed thereon). That is, the guiding grooves 34 and the locking protrusions 36 are both provided at the outer walls 32. Consequently, compared to the case where the guiding grooves 34 and the locking protrusions 36 are provided at separate walls, the configuration is simpler, and miniaturization is possible.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, through paths are formed in the following places: in the space between the housing and the holder; and in the space between the housing, the holder, and a space extending through the interior of the holder. However, according to the present invention, through paths may either extend only through the interior of the holder, or in the space between the housing and the holder, and a space extending through the interior of the housing.

(2) In the embodiment described above, the cable is joined by pressure contact to the pressure contact blades at the same time as the holder and the housing are joined together. However, the present invention is also suitable for the case whereby the flat cable is first joined by pressure contact to the pressure contact blades, and then a jig or the like is employed to attach the holder to the housing.

(3) In the embodiment described above, the pressure contact terminal fittings were female. However, the present invention is also suitable for the case whereby the pressure contact terminal fittings are male.

(4) In the embodiment described above, the flat cable is joined by pressure contact to the pressure contact blades by pushing this flat cable in the lengthwise direction of the pressure contact terminal fittings. However, according to the present invention, the flat cable may be joined by pressure contact by being pushed in a direction that is perpendicular to the lengthwise direction of the pressure contact terminal fittings (for example, from above, below, or from the side).

I claim:

1. An electrical connector for a flat cable, the connector being fittable to a corresponding connector in a fitting direction, comprising:

a housing defining a pressure contact region;

a pressure contact terminal within said region adapted for contact with a flat cable; and a cover attachable to said housing and having first and second holes formed in a face of the cover, wherein:

said attached cover encloses the pressure contact region, said housing and attached cover define first and second openings, proximate to first and second ends of the pressure contact region, through which a flat cable may pass, said housing and attached cover further define a first set of alternate angularly displaced internal paths for a flat cable, one of said paths extending from the first end of the pressure contact region and exiting the connector through the first opening, and another path extending from the first end of the pressure contact region and exiting the connector through the first hole, and said housing and attached cover further define a second set of alternate angularly displaced internal paths for a flat cable, one of said paths extending from the second end of the pressure contact region and exiting the connector through the second opening, and another path extending from the second end of the pressure contact region and exiting the connector through the second hole.

2. A connector according to claim 1 wherein a flat cable routed on the path extending from the first end of the pressure contact region and exiting the connector through the first hole extends from the connector in a direction substantially parallel to the fitting direction, and wherein a flat cable routed on the path extending from the second end of the pressure contact region and exiting the connector through the second hole extends from the connector in a direction substantially parallel to the fitting direction.

3. A connector according to claim 2 wherein a flat cable routed on the path extending from the first end of the pressure contact region and exiting the connector through the first opening extends from the connector in a direction substantially perpendicular to the fitting direction, and wherein a flat cable routed on the path extending from the second end of the pressure contact region and exiting the connector through the second opening extends from the connector in a direction substantially perpendicular to the fitting direction.

4. A connector according to claim 1 wherein a flat cable routed on the path extending from the first end of the pressure contact region and exiting the connector through the first opening extends from the connector in a direction substantially perpendicular to the fitting direction, and wherein a flat cable routed on the path extending from the second end of the pressure contact region and exiting the connector through the second opening extends from the connector in a direction substantially perpendicular to the fitting direction.

5. A connector according to claim 1 wherein said first and second ends of the pressure contact region comprise strain relieving channels adapted to grip said flat cable between said housing and cover.

6. A connector according to claim 5 wherein the strain relieving channels are formed by maintaining ribs formed on the housing and corresponding maintaining grooves formed on the cover.

7. A connector according to claim 5, wherein said housing has opposite protrusions adapted to locate said cable laterally in said region, and wherein said protrusions define shaped guiding members for engagement with corresponding shaped guiding members of said cover.

8. A connector according to claim 7 wherein said shaped guiding members comprise mutually engageable grooves and ribs.

9. A connector according to claim 8 wherein two parallel grooves are provided on a first side of said cover and two parallel grooves are provided on a second side of said cover, and wherein locking projections are provided between said grooves on said first and second sides of said cover for engagement in corresponding locking recesses of said housing.

10. A connector according to claim 1 wherein said housing has opposite protrusions adapted to locate said cable laterally in said region.

11. A connector according to claim 10 wherein said protrusions define shaped guiding members for engagement with corresponding shaped guiding members of said cover.

12. A connector according to claim 11 wherein said shaped guiding members comprise mutually engageable grooves and ribs.

13. A connector according to claim 12 wherein two parallel grooves are provided on a first side of said cover and two parallel grooves are provided on a second side of said cover, and wherein locking projections are provided between said grooves on said first and second sides of said cover for engagement in corresponding locking recesses of said housing.

14. A connector according to claim 1 wherein said cover is attachable to said housing by mutually engageable locking members.

* * * * *